US010527334B2

(12) United States Patent
Nishimura et al.

(10) Patent No.: US 10,527,334 B2
(45) Date of Patent: Jan. 7, 2020

(54) REFRIGERATION SYSTEM

(71) Applicant: DAIKIN INDUSTRIES, LTD., Osaka-shi, Osaka (JP)

(72) Inventors: Tadafumi Nishimura, Sakai (JP); Satoshi Ishida, Sakai (JP); Nobuki Matsui, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 787 days.

(21) Appl. No.: 14/346,279

(22) PCT Filed: Sep. 26, 2012

(86) PCT No.: PCT/JP2012/074697

§ 371 (c)(1),
(2) Date: Mar. 20, 2014

(87) PCT Pub. No.: WO2013/047582

PCT Pub. Date: Apr. 4, 2013

(65) Prior Publication Data

US 2014/0223941 A1 Aug. 14, 2014

(30) Foreign Application Priority Data

Sep. 30, 2011 (JP) ..... 2011-217495

(51) Int. Cl.
*F25B 49/02* (2006.01)

(52) U.S. Cl.
CPC ..... *F25B 49/02* (2013.01); *F24F 2221/50* (2013.01); *F25B 2313/0233* (2013.01); *F25B 2600/2513* (2013.01)

(58) Field of Classification Search
CPC ..... F25B 49/02; F25B 2313/0233; F25B 2315/02; F25B 2600/2513; F25B 5/05; F24F 2011/0043; F24F 2221/50
See application file for complete search history.

(56) References Cited

U.S. PATENT DOCUMENTS 5,230,223 A * 7/1993 Hullar ..... F25B 41/006 62/126
2010/0024454 A1* 2/2010 Kawano ..... F25B 13/00 62/222

FOREIGN PATENT DOCUMENTS

JP 4-28970 A 1/1992
JP 04116347 A * 4/1992
(Continued)

OTHER PUBLICATIONS

JP 2010270971 A, MITOMA, Multi-type Air Conditioner, Dec. 2010.*

(Continued)

*Primary Examiner* — Frantz F Jules
*Assistant Examiner* — Lionel Nouketcha
(74) *Attorney, Agent, or Firm* — Global IP Counselors, LLP

(57) ABSTRACT

A refrigeration system includes a heat source unit, a plurality of utilization units, a height-associated value detection unit and a pressure control unit. The heat source unit has a compressor and a heat source-side heat exchanger that functions as a radiator. Each utilization unit has a pressure reducer and a utilization-side heat exchanger that functions as an evaporator. The height-associated value detection unit detects a height-associated value of each utilization unit. The height associated value of each utilization unit corresponds to a height of the utilization unit. The height of each utilization unit is a vertical distance between the utilization unit and the heat source unit. The pressure control unit determines whether each of the utilization units is in operation or stopped and performs refrigerant pressure control based on the height-associated values of the utilization units that have been determined to be in operation.

10 Claims, 5 Drawing Sheets

(56) References Cited

FOREIGN PATENT DOCUMENTS

| | | | | |
|---|---|---|---|---|
| JP | 2001-317791 | A | | 11/2001 |
| JP | 2010-270971 | A | | 12/2010 |
| JP | 2010270971 | A | * | 12/2010 |
| JP | 2011-47552 | A | | 3/2011 |
| JP | 2011047552 | A | * | 3/2011 |

OTHER PUBLICATIONS

International Search Report of corresponding PCT Application No. PCT/JP2012/074697.
European Search Report of corresponding EP Application No. 12 83 6455.1 dated May 21, 2015.
International Preliminary Report of corresponding PCT Application No. PCT/JP2012/074697.

* cited by examiner

REFRIGERATION SYSTEM

CROSS-REFERENCE TO RELATED APPLICATIONS

This U.S. National stage application claims priority under 35 U.S.C. § 119(a) to Japanese Patent Application No. 2011-217495, filed in Japan on Sep. 30, 2011, the entire contents of which are hereby incorporated herein by reference.

TECHNICAL FIELD

The present invention relates to a refrigeration system and particularly to refrigerant pressure control in a refrigeration system.

BACKGROUND ART

Conventionally, refrigeration systems have been known where the high pressure in the refrigeration cycle is controlled in such a way as to become a target high pressure value. For example, in the system of JP-A No. 2011-47552, control of the high pressure of the refrigerant is performed in consideration of a drop in pressure resulting from the liquid head of a connection pipe caused by a difference in the installation positions of a heat source unit and utilization units. Specifically, the longest length in the scope of warranty set in the system is not manually input as the height of the connection pipe, but rather a connection pipe height determination processing operation for computing the height is performed after the installation of the system, whereby the height is calculated. Controlling the operating frequency of a compressor in accordance with the height, for example, on the basis of this height is disclosed in JP-A No. 2011-47552, Because of this, a situation where the high pressure ends up becoming higher than necessary is avoided, and the system can operate efficiently.

SUMMARY

Technical Problem

However, in the system pertaining to JP-A No. 2011-47552, in a case where the plural utilization units are at different heights or have different capacities, the average value of the heights or the height of the utilization unit with the largest refrigerant flow rate is calculated as the height of the connection pipe.

It is an object of the present invention to allow a refrigeration system including plural utilization units to operate with greater efficiency than conventionally.

Solution to Problem

A refrigeration system pertaining to a first aspect of the present invention is equipped with a heat source unit, plural utilization units, a height-associated value detection unit, and a pressure control unit. The heat source unit has a compressor and a heat source-side heat exchanger that functions as a radiator. The utilization units each have a pressure reducer and a utilization-side heat exchanger that functions as an evaporator. The height-associated value detection unit detects, in regard to each of the utilization units, height-associated values corresponding to heights that are vertical distances between the utilization units and the heat source unit. The pressure control unit determines whether each of the utilization units is in operation or stopped and performs refrigerant pressure control on the basis of the height-associated values of the utilization units that have determined to be in operation. Here, the height-associated values may be the heights themselves using distance as the unit of measurement, or may be amounts of decrease in the pressures of the refrigerant caused by the heights.

In this refrigeration system equipped with the plural utilization units, when the compressor is driven, the refrigerant circulates between the heat source unit and the utilization units in operation, the cold heat that the refrigerant has obtained as a result of releasing heat in the heat source-side heat exchanger is carried to the utilization-side heat exchangers, and the refrigerant evaporates in the utilization-side heat exchangers. Here, because there are plural utilization units, it is conceivable that the heights between each of the utilization units and the heat source unit will not all be the same. Thus, here, the height-associated value detection unit detects, in regard to each of the utilization units, the height-associated values corresponding to the heights. Additionally, the pressure control unit performs the refrigerant pressure control on the basis of the height-associated values of the utilization units that have determined to be in operation. For example, supposing a case where there are five utilization units and their respective height-associated values are different and three of the five utilization units are in operation, then the refrigerant pressure control is performed on the basis of the height-associated value of the one utilization unit whose height is the largest among those three utilization units. Even if the height of one of the two utilization units not in operation (stopped) is the largest among the five utilization units, the refrigerant pressure control is performed on the basis of the height-associated values of the utilization units in operation and not on the basis of the height-associated values of the utilization units that are stopped. Because of this, inefficient operations in which the refrigerant pressure is increased more than necessary can be eliminated, and in the present invention, the refrigeration system can operate with greater efficiency than conventionally. That is, in the present invention, the height-associated value detection unit determines whether each of the utilization units is in operation or stopped and the pressure control unit performs pressure control that ensures the refrigerant pressure needed at any given time, on more energy can be saved than conventionally.

A refrigeration system pertaining to a second aspect of the present invention is the refrigeration system pertaining to the first aspect, wherein the pressure reducers are expansion valves whose opening degrees are adjustable. The height-associated value detection unit detects the height-associated values of the utilization units for the pressure control by first having the refrigeration system perform a cooling operation using supposed height-associated values and adjusting the supposed height-associated values on the basis of changes in the state of the refrigerant with respect to adjustments to the opening degrees of the expansion valves.

Here, the height-associated value detection unit monitors changes in the state of the refrigerant with respect to adjustments to the opening degrees of the expansion valves and detects the height-associated values on the basis of the monitoring results. Because changes in the state of the refrigerant are often monitored even during normal operation control, here, the height-associated values can be detected without adding sensors for grasping changes in the state of the refrigerant.

A refrigeration system pertaining to a third aspect of the present invention is the refrigeration system pertaining to the second aspect, wherein the height-associated value detection unit first has the refrigeration system perform a cooling operation using supposed height-associated values that are height-associated values of the utilization units when it is supposed that the heights are zero, repeatedly adjusts the supposed height-associated values on the basis of changes in the state of the refrigerant with respect to adjustments to the opening degrees of the expansion valves, and, when the magnitudes of the changes in the state of the refrigerant with respect to the adjustments to the opening degrees of the expansion valves fall within a predetermined range, stores the supposed height-associated values as the height-associated values of the utilization units for the pressure control.

Here, the height-associated value detection unit repeatedly adjusts the supposed height-associated values and, when the values converge, stores the supposed height-associated values in adjustment as true height-associated values. For this reason, the height-associated values of each of the utilization units can be detected with relatively high precision.

A refrigeration system pertaining to a fourth aspect of the present invention is the refrigeration system pertaining to the third aspect, wherein the height-associated value detection unit adjusts the supposed height-associated values on the basis of changes in the degrees of superheat of the refrigerant in outlets of the utilization-side heat exchangers with respect to adjustments to the opening degrees of the expansion valves.

Here, the height-associated value detection unit employs a method wherein it adjusts the supposed height-associated values on the basis of changes in the degrees of superheat of the refrigerant in the outlets of the utilization-side heat exchangers, which are often used as control parameters even during normal operations, so an increase in cost associated, for example, with preparing special sensors to detect the height-associated values can be avoided.

A refrigeration system pertaining to a fifth aspect of the present invention is the refrigeration system pertaining to any of the second aspect to the fourth aspect, wherein the height-associated value detection unit periodically has the refrigeration system perform a cooling operation using supposed height-associated values that are smaller than the height-associated values of the utilization units for the pressure control that are stored and redetects the height-associated values of the utilization units for the pressure control.

Here, the height-associated value detection unit periodically redetects the height-associated values of the utilization units, so even in a case where, due to surrounding environmental conditions or heat load circumstances, the precision of the detection of the height-associated values the first time or the previous time was low, the problem of pressure control based on those height-associated values ending up continuing for a long time can be avoided.

A refrigeration system pertaining to a sixth aspect of the present invention is the refrigeration system pertaining to the first aspect, wherein the pressure reducers are expansion valves whose opening degrees are adjustable. The height-associated value detection unit first has the refrigeration system perform a cooling operation using supposed height-associated values that are height-associated values of the utilization units when it is supposed that the heights are an upper limit, finds the amounts of refrigerant flowing through each of the utilization units, calculates the pressures of the refrigerant when it enters each of the utilization units from the opening degrees of the expansion valves of each of the utilization units, and thereby detects the height-associated values of the utilization units for the pressure control.

Here, the height-associated value detection unit first has the refrigeration system perform a cooling operation using supposed height-associated values that are height-associated values of the utilization units when it is supposed that the heights are an upper limit, so there is virtually no longer a situation where some of the liquid refrigerant ends up gasifying before entering the expansion valves of the utilization units, and the amount of refrigeration in circulation is stable. Additionally, the height-associated value detection unit finds the pressures of the refrigerant before it enters each of the utilization units from the amounts of refrigerant flowing through the utilization units and the opening degrees of the expansion valves of each of the utilization units, and thereby detects the height-associated values, so the height-associated values can be detected with relatively high precision.

A refrigeration system pertaining to a seventh aspect of the present invention is the refrigeration system pertaining to any of the first aspect to the sixth aspect, wherein the plural utilization units belong to any of plural groups. The height-associated value detection unit detects the height-associated values in regard to one of the utilization units in each of the groups and applies those height-associated values to the other utilization units in the groups.

In refrigeration systems equipped with plural utilization units, it is conceivable that the heights between each of the utilization units and the heat source unit will not all be the same, and oftentimes there are plural utilization units that are installed at similar height positions. Thus, here, the height-associated value detection unit employs a method wherein it sets groups and applies the height-associated values detected in regard to one of the utilization units in each of the groups to the other utilization units in the groups. Consequently, by making a setting that causes the plural utilization units whose height positions are the same as or near one another to belong to single same groups, the height-associated values can be detected in regard to all of the utilization units without having to perform a special operation for detecting the height-associated values in regard to all of the utilization units.

A refrigeration system pertaining to an eighth aspect of the present invention is the refrigeration system pertaining to any of the first aspect to the seventh aspect, wherein the height-associated value detection unit detects the height-associated values in regard to each of the utilization units during a test operation preformed at the time of installation of the heat source unit and the plural utilization units or during a cooling operation.

In a case where the detection of the height-associated values is performed during a test operation, there is no hindrance to allowing all of the utilization units to operate, and a detection operation in which loud sounds occur in the expansion valves also becomes possible. In a case where the detection of the height-associated values is performed during the first or a normal cooling operation, the detection operation can be performed in astute in which cooling loads exist as they are in actuality, and there is the advantage that the detection operation does not become a low capacity operation.

Advantageous Effects of Invention

In the refrigeration system pertaining to the first aspect of the present invention, even if the height of a utilization unit that is stopped is the largest among all of the utilization units, the refrigerant pressure control is performed on the basis of the height-associated values of the utilization units in operation and not on the basis of the height-associated values of the utilization units that are stopped. For this reason, inefficient operations in which the refrigerant pressure is increased more than necessary can be eliminated, and the refrigeration system can operate with greater efficiency than conventionally.

In the refrigeration system pertaining to any of the second aspect to the fourth aspect of the present invention, an increase in cost associated, for example, with preparing special sensors to detect the height-associated values can be avoided.

In the refrigeration system pertaining to the fifth aspect of the present invention, even in a case where a detection of height-associated values whose precision is low has ended up being performed, the problem of pressure control based on those height-associated values ending up continuing for a long time can be avoided.

In the refrigeration system pertaining to the sixth aspect of the present invention, the height-associated values can be detected with relatively high precision in a state in which the amount of refrigerant in circulation is stable.

In the refrigeration system pertaining to the seventh aspect of the present invention, the height-associated values can be detected in regard to all of the utilization units without having to perform a special operation for detecting the height-associated values in regard to all of the utilization units.

In the refrigeration system pertaining to the eighth aspect of the present invention, not allowing the detection of the height-associated values to make the user uncomfortable or performing the height-associated value detection operation at a relatively high capacity and with good precision can be realized.

BRIEF DESCRIPTION OF THE DRAWINGS

DESCRIPTION OF EMBODIMENT (1) Overall Configuration of Air Conditioning System FIG. 1 shows the installation of an air conditioning system 10 that is a refrigeration system pertaining to an embodiment of the present invention. The air conditioning system 10 is a distributed air conditioning system interconnected by refrigerant pipes and is a system that cools and heats rooms on each floor in a building BL by performing a vapor compression refrigeration cycle operation. The air conditioning system 10 is equipped with an outdoor unit 20 serving as a heat source unit, numerous indoor units 30 serving as utilization units, and a first refrigerant connection pipe 6 and a second refrigerant connection pipe 7 serving as refrigerant connection pipes that interconnect the outdoor unit 20 and the indoor units 30. That is, a refrigerant circuit of the air conditioning system 10 shown in FIG. 2 is configured as a result of the outdoor unit 20, the indoor units 30, and the refrigerant connection pipes 6 and 7 being interconnected. Additionally, refrigerant is sealed in the refrigerant circuit shown in FIG. 2, and as described later, a refrigeration cycle operation is performed wherein the refrigerant is compressed, cooled, reduced in pressure, heated and evaporated, and thereafter again compressed. A refrigerant selected from R410A, R407C, R22, R134a, and carbon dioxide, for example, is used as the refrigerant.

(2) Detailed Configuration of Air Conditioning System (2-1) Indoor Units

Figure 1:
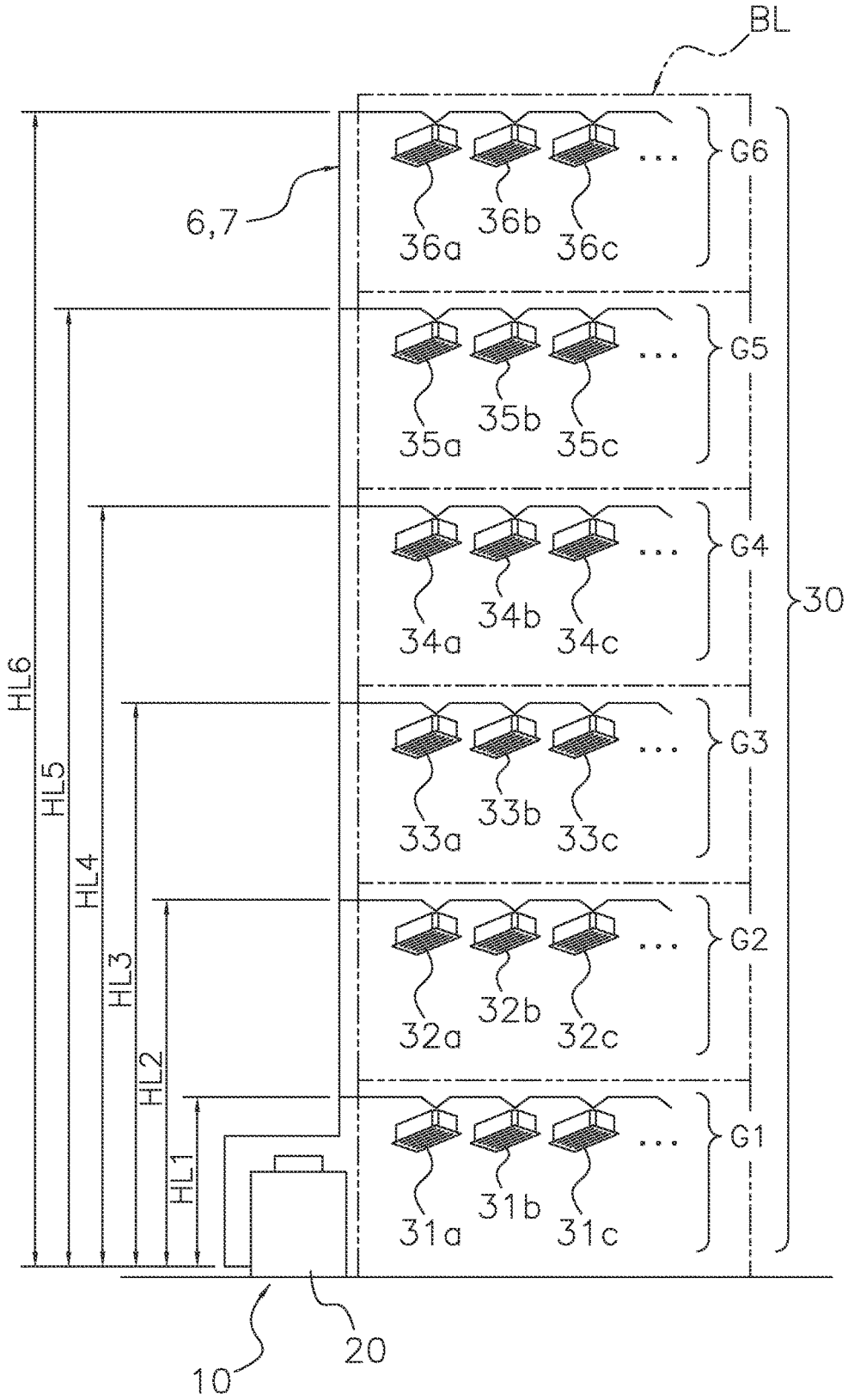
FIG. 1 is a schematic diagram showing the installation of a distributed air conditioning system interconnected by refrigerant pipes pertaining to an embodiment of the present invention.

The indoor units 30 are installed in ceilings or side walls on each floor in the building BL and are connected to the outdoor unit 20 via the refrigerant connection pipes 6 and 7. As shown in FIG. 1, here, of the numerous indoor units 30, indoor units 31*a*, 31*b*, 31*c*, etc. are disposed on a first floor of the building BL, indoor units 32*a*, 32*b*, 32*c*, etc. are disposed on a second floor of the building BL, indoor units 33*a*, 33*b*, 33*c*, etc. are disposed on a third floor of the building BL, indoor units 34*a*, 34*b*, 34*c*, etc. are disposed on a fourth floor of the building BL, indoor units 35*a*, 35*b*, 35*c*, etc. are disposed on a fifth floor of the building BL, and indoor units 36*a*, 36*b*, 36*c*, etc. are disposed on a sixth floor of the building BL. As described later in example modification E, initial settings are made in a control unit 8 prior to a test operation so that the indoor units 31*a*, 31*b*, 31*c*, etc., disposed on the first floor belong to a group G1, the indoor units 32*a*, 32*b*, 32*c*, etc. disposed on the second floor belong to a group G2, the indoor units 33*a*, 33*b*, 33*c*, etc. disposed on the third floor belong to a group G3, the indoor units 34*a*, 34*b*, 34*c*, etc., disposed on the fourth floor belong to a group G4, the indoor units 35*a*, 35*b*, 35*c*, etc. disposed on the fifth floor belong to a group G5, and the indoor units 36*a*, 36*b*, 36*c*, etc. disposed on the sixth floor belong to a group G6. Furthermore, as shown in FIG. 1, the positions where the indoor units 31*a*, 31*b*, 31*c*, etc. of the first floor belonging to the group G1 connect to the first refrigerant connection pipe 6 are located in positions a distance HL1 higher than a liquid-side stop valve 28*a* of the outdoor unit 20 (see FIG. 2). That is, the distance HL1 is the height between the outdoor unit 20 and the indoor units 31*a*, 31*b*, 31*c*, etc. of the first floor belonging to the group G1. Likewise, a distance HL2 is the height between the outdoor unit 20 and the indoor units 32*a*, 32*b*, 32*c*, etc. of the second floor belonging to the group G2, a distance HL3 is the height between the outdoor unit 20 and the indoor units 33*a*, 33*b*, 33*c*, etc. of the third floor belonging to the group G3, a distance HL4 is the height between the outdoor unit 20 and the indoor units 34*a*, 34*b*, 34*c*, etc. of the fourth floor belonging to the group G4, a distance HL5 is the height between the outdoor unit 20 and the indoor units 35*a*, 35*b*, 35*c*, etc. of the fifth floor belonging to the group G5, and a distance HL6 is the height between the outdoor unit 20 and the indoor units 36*a*, 36*b*, 36*c*, etc. of the sixth floor belonging to the group G6.

Figure 2:
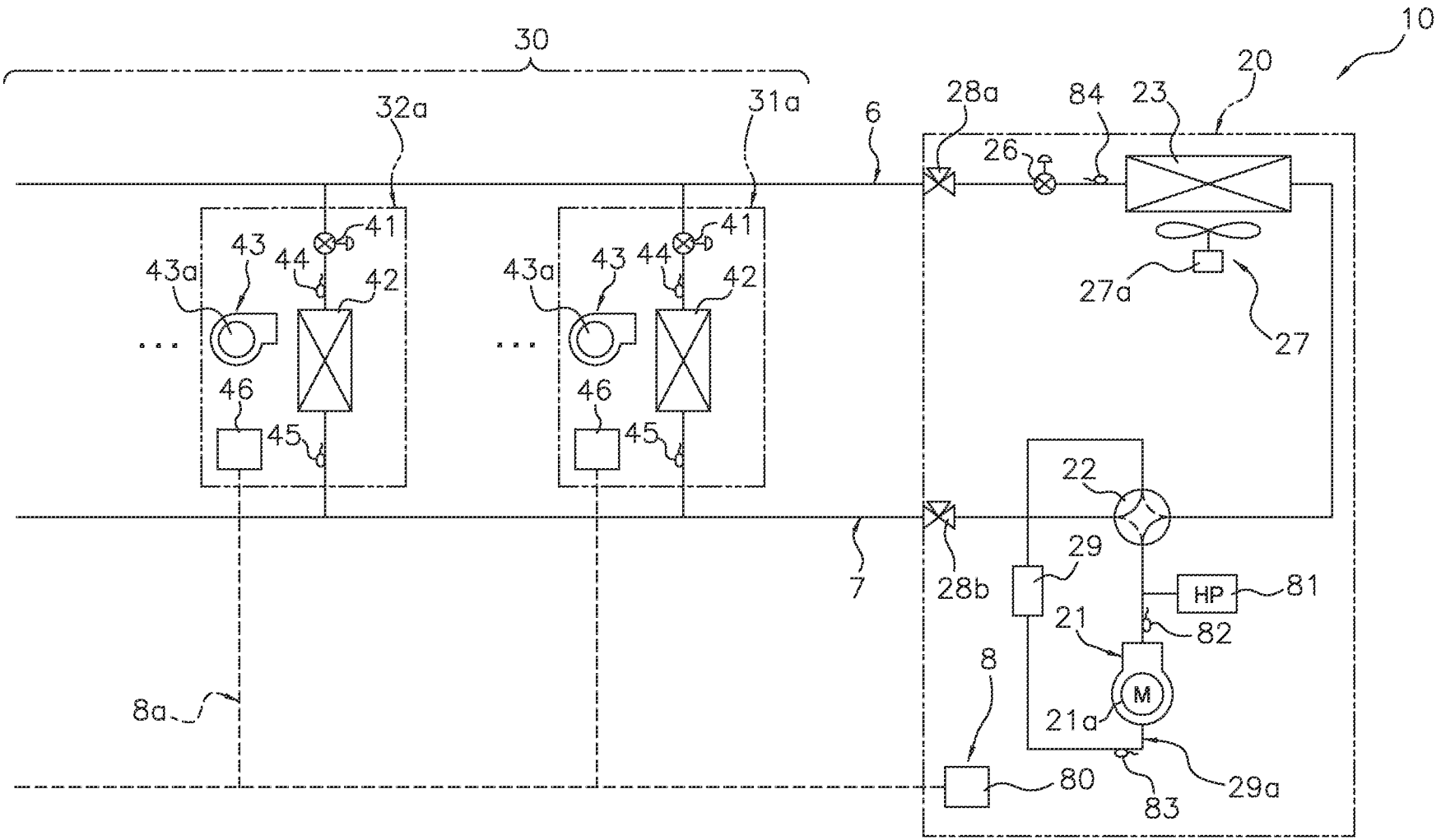
FIG. 2 is a diagram showing a refrigerant pipe system of the air conditioning system.

Next, the configuration of the indoor units 30 will be described. The indoor units 30 have the same configuration, so here only the configuration of the indoor unit 31*a* shown in FIG. 2 is described and description of the configurations of the indoor unit 31*b* and the other indoor units is omitted.

The indoor unit 31*a* mainly has an indoor expansion valve 41 that is a pressure reducer and an indoor heat exchanger 42 that serves as a utilization-side heat exchanger.

The indoor expansion valve 41 is a mechanism for reducing the pressure of the refrigerant and is an electrically-powered valve whose opening degree is adjustable. One end of the indoor expansion valve 41 is connected to the first refrigerant connection pipe 6, and the other end of the indoor expansion valve 41 is connected to the indoor heat exchanger 42.

The indoor heat exchanger 42 is a heat exchanger that functions as a heater or a cooler of the refrigerant. One end of the indoor heat exchanger 42 is connected to the indoor expansion valve 41, and the other end of the indoor heat exchanger 42 is connected to the second refrigerant connection pipe 7.

The indoor unit 31*a* is equipped with an indoor fan 43 for sucking room air into the unit and supplying the air back to the room, and the indoor fan 43 allows heat to be exchanged between the room air and the refrigerant flowing through the indoor heat exchanger 42. The indoor fan 43 is driven to rotate by an indoor fan motor 43*a*.

Furthermore, various sensors are disposed in the indoor unit 31*a*. Specifically, an indoor liquid pipe temperature sensor 44 and an indoor gas pipe temperature sensor 45 comprising thermistors are disposed, and these sensors measure the temperatures of refrigerant pipes near the indoor heat exchanger 42. Moreover, the indoor unit 31*a* has an indoor control unit 46 that controls the actions of each part configuring the indoor unit 31*a*. The indoor control unit 46 has a microcomputer and a memory disposed in order to control the indoor unit 31*a*, and the indoor control unit 46 can exchange control signals and so forth with a remote controller (not shown in the drawings) for individually operating the indoor unit 31*a* and exchange control signals and so forth with a later-described outdoor control unit 80 of the outdoor unit 20 via a transmission line 8*a*.

(2-2) Outdoor Unit

The outdoor unit 20 is installed outside the building BL or in the basement of the building BL and is connected to the indoor units 30 via the refrigerant connection pipes 6 and 7. The outdoor unit 20 mainly has a compressor 21, a switching mechanism 22, an outdoor heat exchanger 23, an outdoor expansion valve 26, a liquid-side stop valve 28*a*, a gas-side stop valve 28*b*, and an accumulator 29.

The compressor 21 is a closed compressor driven by a compressor motor 21*a*. There is only one compressor 21 in the present embodiment, but the number of compressors is not limited to this, and two or more compressors may also be connected in parallel in accordance with the number of the indoor units 30 connected thereto, for example.

The switching mechanism 22 is a mechanism for switching the direction of the flow of the refrigerant. During the cooling operation, the switching mechanism 22 interconnects a refrigerant pipe on the discharge side of the compressor 21 and one end of the outdoor heat exchanger 23 and also interconnects a compressor suction pipe 29*a* (including the accumulator 29) on the suction side of the compressor 21 and the gas-side stop valve 28*b* in order to cause the outdoor heat exchanger 23 to function as a radiator of the refrigerant compressed by the compressor 21 and to cause the indoor heat exchangers 42 to function as evaporators of the refrigerant cooled in the outdoor heat exchanger 23 (see the solid lines of the switching mechanism 22 in FIG. 1). Furthermore, during the heating operation, the switching mechanism 22 interconnects the refrigerant pipe on the discharge side of the compressor 21 and the gas-side stop valve 28*b* and also interconnects the compressor suction pipe 29*a* and the one end of the outdoor heat exchanger 23 in order to cause the indoor heat exchangers 42 to function as radiators of the refrigerant compressed by the compressor 21 and to cause the outdoor heat exchanger 23 to function as an evaporator of the refrigerant cooled in the indoor heat exchangers 42 (see the dashed lines of the switching mechanism 22 in FIG. 1). In the present embodiment, the switching mechanism 22 is a four-way switching valve connected to the compressor suction pipe 29*a*, the refrigerant pipe on the discharge side of the compressor 21, the outdoor heat exchanger 23, and the gas-side stop valve 28*b*. The switching mechanism 22 is not limited to a four-way switching valve and may also be a mechanism configured to have the same function as the one described above of switching the direction of the flow of the refrigerant by combining plural electromagnetic valves, for example.

The outdoor heat exchanger 23 is a heat exchanger that functions as a radiator or an evaporator (heater) of the refrigerant. One end of the outdoor heat exchanger 23 is connected to the switching mechanism 22, and the other end of the outdoor heat exchanger 23 is connected to the outdoor expansion valve 26.

The outdoor unit 20 has an outdoor fan 27 for sucking outdoor air into the unit and expelling the air back outdoors. The outdoor fan 27 allows heat to be exchanged between the outdoor air and the refrigerant flowing through the outdoor heat exchanger 23 and is driven to rotate by an outdoor fan motor 27*a*. The heat source of the outdoor heat exchanger 23 is not limited to outdoor air and may also be another heat medium such as water.

The outdoor expansion valve 26 is a mechanism for reducing the pressure of the refrigerant and is an electrically-powered valve whose opening degree is adjustable. One end of the outdoor expansion valve 26 is connected to the outdoor heat exchanger 23, and the other end of the outdoor expansion valve 26 is connected to the liquid-side stop valve 28*a*.

The liquid-side stop valve 28*a* is a valve to which the first refrigerant connection pipe 6 for exchanging the refrigerant between the outdoor unit 20 and the indoor units 30 is connected, and the liquid-side stop valve 28*a* is connected to the outdoor expansion valve 26. The gas-side stop valve 28*b* is a valve to which the second refrigerant connection pipe 7 for exchanging the refrigerant between the outdoor unit 20 and the indoor units 30 is connected, and the gas-side stop valve 28*b* is connected to the switching mechanism 22. Here, the liquid-side stop valve 28*a* and the gas-side stop valve 28*b* are three-way valves equipped with service ports.

The accumulator 29 is disposed on the compressor suction pipe 29*a* between the switching mechanism 22 and the compressor 21.

Furthermore, various sensors are disposed in the outdoor unit 20. Specifically, a discharge pressure sensor 81 that detects the compressor discharge pressure in the refrigerant pipe on the discharge side of the compressor 21, a discharge temperature sensor 82 that detects the compressor discharge temperature, a suction temperature sensor 83 that detects the temperature of the gas refrigerant sucked into the compressor 21 in the compressor suction pipe 29*a*, and an outdoor liquid pipe temperature sensor 84 that detects the temperature of the refrigerant in a refrigerant pipe joining the outdoor heat exchanger 23 and the outdoor expansion valve 26 are disposed. The temperature sensors 82, 83, and 84 comprise thermistors. Moreover, the outdoor unit 20 has an outdoor control unit 80 that controls the actions of each part configuring the outdoor unit 20. The outdoor control unit 80 has a microcomputer and a memory disposed in order to control the outdoor unit 20 and exchanges control signals and so forth with the indoor control units 46 of the indoor units 30 via the transmission line 8*a*. As described later, a control unit 8 is configured by the outdoor control unit 80 and the indoor control units 46.

(2-3) Refrigerant Connection Pipes

The refrigerant connection pipes 6 and 7 are refrigerant pipes constructed on site when installing the outdoor unit 20 and the indoor units 30 in an installation location.

(2-4) Control Unit

Figure 3:
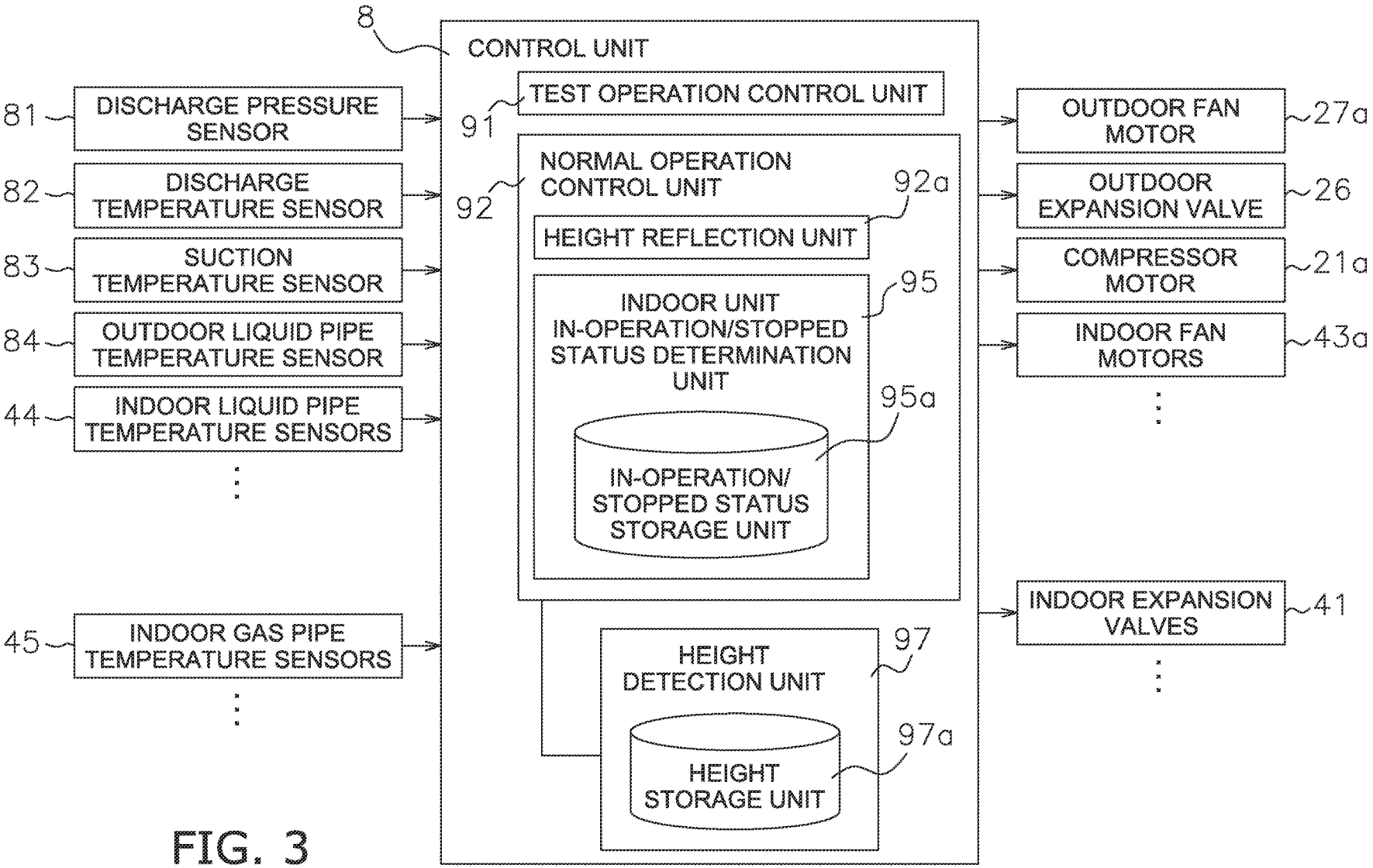
FIG. 3 is a control block diagram of the air conditioning system.

The control unit 8, which serves as control means that controls the various operations of the air conditioning system 10, is configured by the outdoor control unit 80 and the indoor control units 46 that are joined via the transmission line 8*a* as shown in FIG. 2. FIG. 3 shows a control block diagram of the air conditioning system 10. The control unit 8 receives detection signals from the various sensors 81, 82, 83, 84, 44, and 45 and controls the various devices 27*a*, 26, 21*a*, 43*a*, and 41 on the basis of these detection signals and so forth.

The control unit 8 has, as functional units, a test operation control unit 91 for test operations, a normal operation control unit 92 for controlling normal operations such as the cooling operation, and a later-described height detection unit 97. Furthermore, the normal operation control unit 92 includes an indoor unit in-operation/stopped status determination unit 95. The control unit 8 is also equipped with storage units including an in-operation/stopped status storage unit 95*a* that stores the in-operation/stopped statuses of each of the indoor units 30 and a height storage unit 97*a* that stores height data that have been detected in regard to each of the indoor units 30.

(3) Actions of Air Conditioning System

Next, basic actions of the air conditioning system 10 pertaining to the present embodiment will be described. Control in the various operations described below is performed by the control unit 8 functioning as operation control means.

(3-1) Basic Actions of Cooling Operation

The cooling operation is implemented by the normal operation control unit 92 of the control unit 8. During the cooling operation, the switching mechanism 22 switches to the state indicated by the solid lines in FIG. 1, that is, astute in which the gas refrigerant discharged from the compressor 21 flows to the outdoor heat exchanger 23 and the compressor suction pipe 29*a* is connected to the gas-side stop valve 28*b*. The outdoor expansion valve 26 is in a completely open state and the opening degrees of the indoor expansion valves 41 are adjusted. The stop valves 25 and 26 are in an open state.

In this state of the refrigerant circuit, the high-pressure gas refrigerant that has been discharged from the compressor 21 is sent through the switching mechanism 22 to the outdoor heat exchanger 23 functioning as a radiator of the refrigerant, exchanges heat with outdoor air supplied by the outdoor fan 27, and is cooled. The high-pressure refrigerant that has been cooled and liquefied in the outdoor heat exchanger 23 is sent through the outdoor expansion valve 26 and the first refrigerant connection pipe 6 to each of the indoor units 30. The refrigerant that has been sent to each of the indoor units 30 has its pressure reduced by the indoor expansion valves 41, becomes low-pressure refrigerant in a gas-liquid two-phase state, exchanges heat with room air in the indoor heat exchangers 42 functioning as evaporators of the refrigerant, evaporates, and becomes low-pressure gas refrigerant. Then, the low-pressure gas refrigerant that has been heated in the indoor heat exchangers 42 is sent through the second refrigerant connection pipe 7 to the outdoor unit 20, travels through the switching mechanism 22, and is sucked back into the compressor 21. In this way, cooling of the rooms is performed.

In a case where only some indoor units of the indoor units 30 are in operation, the indoor expansion valves 41 of the indoor units that are stopped are switched to a stopped opening degree (e.g., completely closed). In this case, the refrigerant does not pass through the indoor units 30 whose operation is stopped, and the cooling operation becomes performed only in regard to the indoor units 30 in operation. "Operation is stopped" here means a case where a user has intentionally issued, using a remote controller or the like, a command to an indoor unit 30 to stop operating.

(3-2) Basic Actions of Heating Operation

The heating operation is implemented by the normal operation control unit 92 of the control unit 8. During the heating operation, the switching mechanism 22 switches to the state indicated by the dashed lines in FIG. 1, that is, a state in which the refrigerant pipe on the discharge side of the compressor 21 is connected to the gas-side stop valve 28*b* and the compressor suction pipe 29*a* is connected to the outdoor heat exchanger 23. The opening degrees of the outdoor expansion valve 26 and the indoor expansion valves 41 and 51 are adjusted. The stop valves 25 and 26 are in an open state.

In this state of the refrigerant circuit, the high-pressure gas refrigerant that has been discharged from the compressor 21 is sent through the switching mechanism 22 and the second refrigerant connection pipe 7 to each of the indoor units 30. Then, the high-pressure gas refrigerant that has been sent to each of the indoor units 30 exchanges heat with room air and is cooled in the indoor heat exchangers 42 functioning as radiators of the refrigerant, thereafter travels through the indoor expansion valves 41, and is sent through the first refrigerant connection pipe 6 to the outdoor unit 20. When the refrigerant exchanges heat with the room air and is cooled, the room air is heated. The high-pressure refrigerant that has been sent to the outdoor unit 20 has its pressure reduced by the outdoor expansion valve 26, becomes low-pressure refrigerant in a gas-liquid two-phase state, and flows into the outdoor heat exchanger 23 functioning as an evaporator of the refrigerant. The low-pressure refrigerant in the gas-liquid two-phase state that has flowed into the outdoor heat exchanger 23 exchanges heat with outdoor air supplied by the outdoor fan 27, is heated, evaporates, and becomes low-pressure refrigerant. The low-pressure gas refrigerant that has exited the outdoor heat exchanger 23 travels through the switching mechanism 22 and is sucked back into the compressor 21. In this way, heating of the rooms is performed.

(3-3) Detection of Heights of Indoor Units

The control unit 8 of the air conditioning system 10 pertaining to the present embodiment is equipped with the functional unit of the height detection unit 97 as mentioned above. The height detection unit 97 is a control routine disposed in order to detect (estimate), in regard to each of the indoor units 30, heights (see HL1 to HL6 in FIG. 1) that are vertical distances between each of the indoor units 30 and the outdoor unit 20.

Figure 4:
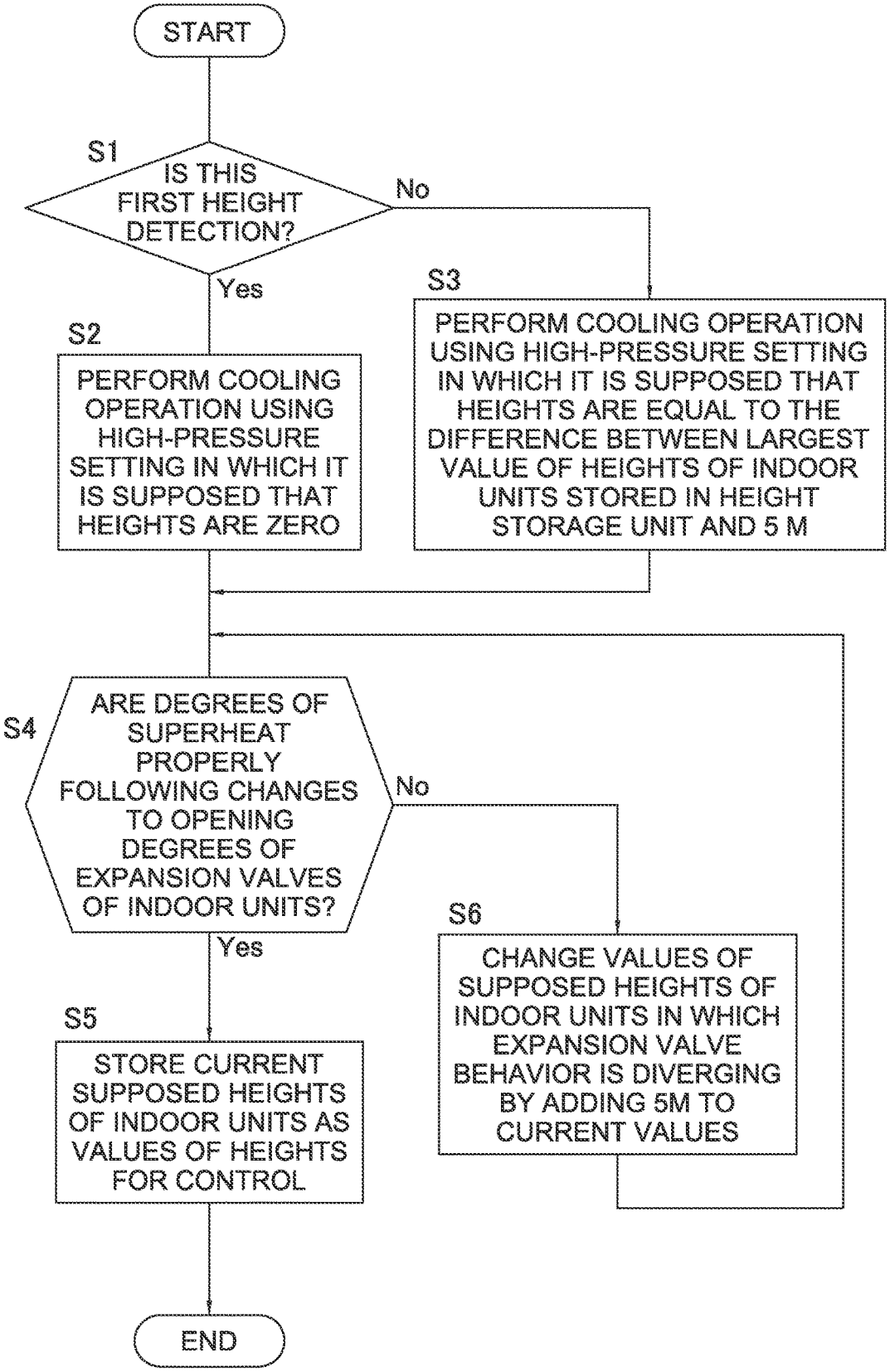
FIG. 4 is a control flow diagram of a height detection operation of the air conditioning system.

FIG. 4 shows a control flow of a height detection operation implemented by the height detection unit 97. The height detection operation is started during a normal cooling operation. The first height detection operation is started during the first cooling operation after the installation of the air conditioning system 10, and subsequent height detection operations from the second time on are started after a later-described predetermined time period has elapsed.

First, in step S1, it is judged whether or not this is the first height detection operation. In a case where this is the first detection operation, the height detection unit 97 moves to stop S2 where a cooling operation is performed in which it is supposed that the heights of all of the indoor units 30 are zero. That is, it is supposed that extra pressure is not needed to push the refrigerant up from the outdoor unit 20 to each of the indoor units 30 and that, during the cooling operation, the refrigerant flows into the indoor expansion valves 41 of the indoor units 30 while maintaining the same pressure as that of the liquid refrigerant when it has exited the outdoor unit 20, and refrigerant pressure control (high-pressure control) in the cooling operation is performed. Specifically, the speed of the compressor 21 and the speed of the outdoor fan 27 are controlled.

In step S4, the height detection unit 97 changes a little at a time the opening degrees of the indoor expansion valves 41 of each of the indoor units 30 in operation and determines whether or not the degrees of superheat of the refrigerant in the outlets of the indoor heat exchangers 42 are properly following the changes to the opening degrees. The degrees of superheat of the refrigerant in the outlets of the indoor heat exchangers 42 are the differences between the evaporation temperature of the refrigerant in the indoor heat exchangers 42 functioning as evaporators and the temperature of the refrigerant in the outlets of the indoor heat exchangers 42. Whether or not the degrees of superheat of the refrigerant are properly following the changes to the opening degrees of the indoor expansion valves 41 is judged from the timings of the changes to the opening degrees and time-series data of the degree of superheat of the refrigerant. If, after the elapse of a predetermined amount of time in which the changes to the opening degrees of the indoor expansion valves 41 have been made, the degrees of superheat of the refrigerant in the outlets of the indoor heat exchangers 42 fall within a predetermined range in the neighborhood of expected values of change, it is judged that the degrees of superheat of the refrigerant are properly following the changes to the opening degrees of the indoor expansion valves 41. If the degrees of superheat of the refrigerant are properly following the changes to the opening degrees of the indoor expansion valves 41, this means that the refrigerant flowing into the indoor expansion valves 41 is in a liquid phase, and if the degrees of superheat of the refrigerant are not properly following the changes to the opening degrees of the indoor expansion valves 41, this means that the refrigerant flowing into the indoor expansion valves 41 is in two phases, gas and liquid, including flash gas. Additionally, if the refrigerant flowing into the indoor expansion valves 41 is in two phases, gas and liquid, including flash gas, this means that the actual heights of those indoor units 30 are greater than the supposed values and that the pressure of the refrigerant flowing into the indoor units 30 has dropped in correspondence thereto.

When it has been judged in step S4 that the degrees of superheat of the refrigerant in the outlets of the indoor heat exchangers 42 are not properly following the changes to the opening degrees of the indoor expansion valves 41, or in other words when it has been judged that the behaviors of the indoor expansion valves 41 are diverging, the height detection unit 97 moves to step S6. In step S6, the height detection unit 97 increases the supposed height values by 5 m in light of the fact that it seems that the heights of those indoor units 30 are greater than the supposed values and that gas-liquid two-phase refrigerant is flowing into the indoor expansion valves 41 and that the behaviors of the indoor expansion valves 41 are diverging. That is if the current value of the height is zero, the height detection unit 97 increases the value of the height to 5 m, and if the current value of the height is 5 m, the height detection unit 97 increases the value of the height to 10 m. Then, the height detection unit 97 returns to step S4 from step S6.

When it has been judged in step S4 that the degrees of superheat of the refrigerant in the outlets of the indoor heat exchangers 42 are properly following the changes to the opening degrees of the indoor expansion valves 41, or in other words when it has been judged that the behaviors of the indoor expansion valves 41 are normal, the height detection unit 97 moves to step S5. In step S5, the height detection unit 97 stores, in the height storage unit 97*a*, the supposed values of the heights at that time as true height values in light of the fact that it seems that the supposed values of the heights of the indoor units 30 are close to the actual true values and that the refrigerant flowing into the indoor expansion valves 41 is in a liquid phase and that the behaviors of the indoor expansion valves 41 are normal.

When the height detection unit 97 finishes storing, in regard to all of the indoor units 30, the values of the heights in the height storage unit 97*a* in step S5, the height detection unit 97 ends the series of height detection operation steps.

When it is judged in step S1 that this is not the first height detection operation, the height detection unit 97 moves to step S3. The operation of detecting the heights of the indoor units 30 that starts with step S1 is periodically executed by the height detection unit 97 even if it has been performed once before. Specifically, the height detection operation is implemented at a rate of once every several hundred hours. In step S3, the height detection unit 97 performs a cooling operation using supposed height values in which 5 m is subtracted from the value that is the largest (largest value) among the values of the heights of each of the indoor units 30 that were stored in the height storage unit 97*a* in the previous height detection operation. Consequently, in step S3, a high-pressure setting cooling operation starts in which it is supposed that the height is 5 m smaller than it had been until then. Thereafter, the height detection unit 97 moves to step S4 where the various judgments and storage of the values of the heights in the height storage unit 97*a* are performed by the same flow as that of the first height detection operation.

(3-4) Pressure Control in Various Operations

The values of the heights that have been detected and stored in the height storage unit 97*a* by the height detection operation performed by the height detection unit 97 in regard to each of the indoor units 30 are utilized in pressure control in the operations implemented by the normal operation control unit 92. An example will be described below where the values of the heights that have been stored in the height storage unit 97*a* are utilized during a cooling operation.

In the cooling operation, as mentioned above, the indoor expansion valves 41 of the indoor units 30 that are stopped are switched to a stopped opening degree (e.g., completely closed). That is, the refrigerant does not flow through the indoor units 30 whose operation is stopped, so when the air conditioning system performs the cooling operation using the minimum high-pressure setting in which the indoor expansion valves 41 of the indoor units 30 in operation do not diverge, the air conditioning system 10 no longer ends up operating with the pressure of the refrigerant being raised more than necessary and it becomes possible for the air conditioning system 10 to operate more energy-efficiently with a smaller differential pressure before and after the compressor 21. In light of this, the normal operation control unit 92 acquires the in-operation/stopped statuses of all of the indoor units 30 from the indoor unit in-operation/stopped status determination unit 95, extracts the value of the height that is the largest among the values of the heights of the one or plural indoor units 30 in operation, and controls the operating frequency of the compressor 21 to reflect the largest height of the indoor unit(s) in operation. When the in-operation/stopped statuses of the indoor units 30 change in such a way that the largest height of the indoor units in operation becomes larger, a height reflection unit 92*a* of the normal operation control unit 92 resets the base operating frequency of the compressor 21 higher than it was until then, and when the in-operation/stopped statuses of the indoor units 30 change in such a way that the largest height of the indoor units in operation becomes smaller, the height reflection unit 92*a* resets the base operating frequency of the compressor 21 lower than it was until then. Specifically, the normal operation control unit 92 carries out a high-pressure setting that is as low as possible in a range in which the refrigerant flowing into the indoor expansion valve 41 of the indoor unit 30 whose height is the largest among the indoor units 30 in operation is in a liquid phase that does not include flash gas.

The indoor unit in-operation/stopped status determination unit 95 of the normal operation control unit 92 receives in-operation/stopped status communications from the indoor control units 46 of each of the indoor units 30 (see FIG. 1) and stores the in-operation/stopped status data in the in-operation/stopped status storage unit 95*a*, (4) Characteristics of Air Conditioning System (4-1)

In the air conditioning system 10 pertaining to the present embodiment, the many indoor units 30 belong to one refrigerant system, and those indoor units 30 are installed on each of the floors of the building BL whose heights are different. For this reason, the heights between each of the indoor units 30 and the outdoor unit 20 are not all the same. Thus, here, the control unit 8 detects the values of the heights in regard to each of the indoor units 30. Additionally, the control unit 8 performs refrigerant pressure control in normal operations such as the cooling operation on the basis of the value of the largest height of the indoor units 30 in operation.

For example, in a case where the five indoor units 31*a*, 32*a*, 33*a*, 34*a*, and 35*a* are in operation in the air conditioning system 10 including the numerous indoor units 30 including the indoor unit 36*a* installed in the highest position, high-pressure control of the refrigerant becomes performed on the basis of the value HL5 of the height of the one indoor unit 35*a* that is the largest among the heights of those five indoor units. The value HL6 of the height of the indoor unit 36*a* that is stopped is larger than the value HL5 of the height of the indoor unit 35*a* in operation (see FIG. 1), but the high-pressure control of the refrigerant is performed on the basis of the height HL5 of the indoor unit 35*a* in operation and not on the basis of the height of the indoor unit 36*a* that is stopped. Because of this inefficient operations in which the operating frequency of the compressor 21 is raised to increase the refrigerant pressure more than necessary can be eliminated, and the air conditioning system 10 can operate efficiently. That is, in the air conditioning system 10 pertaining to the present embodiment, the control unit 8 determines whether each of the indoor units 30 is in operation or stopped and performs high-pressure control that ensures the refrigerant pressure needed at any given time, so energy can be saved.

(4-2)

In the air conditioning system 10 pertaining to the present embodiment, the control unit 8 monitors changes in the state of the refrigerant (specifically, the degrees of superheat of the refrigerant in the outlets of the indoor heat exchangers 42) with respect to adjustments to the opening degrees of the indoor expansion valves 41 and detects the heights of each of the indoor units 30 on the basis of the monitoring results. The activity of monitoring the degrees of superheat of the refrigerant in the outlets of the indoor heat exchangers 42 and feedback-controlling the indoor expansion valves 41 is itself performed in normal operations and is not unique to the operation of detecting the heights of the indoor units 30. That is, it is not necessary, for example, to add special sensors for the operation of detecting the heights of the indoor units 30, and so the cost of the air conditioning system 110 can be kept from increasing.

Furthermore, by repeating step S4 and step S6, the values of the heights of each of the indoor units 30 can be detected (estimated) with relatively high precision.

(4-3)

In the air conditioning system 10 pertaining to the present embodiment, the operation of detecting the heights of the indoor units 30 that starts with step S1 is periodically executed by the height detection unit 97. For this reason, even in a case where, due to outside air temperature conditions outside the building BL or heat load circumstances inside the building BL, the precision of the detection of the heights the first time or the previous time was low, the problem of high-pressure control based on the values of those heights ending up continuing for a long time can be avoided. Here, the height detection operation is implemented at a rate of once every several hundred hours, but that frequency may also be changed, and the height detection operation may also be implemented at irregular spans.

(5) Example Modifications (5-1) Example Modification A

In the air conditioning system 10 pertaining to the above-described embodiment, the height detection operation is performed by the control flow shown in FIG. 4, but the method of the height detection operation is not limited to this. For example, the height detection operation may also be performed by the control flow shown in FIG. 5.

Here, first, in step S11, it is judged whether or not the height detection is already finished in regard to all of the indoor units 30. If the height detection is not finished, the height detection unit 97 moves to step S12. If the height detection is finished, the height detection unit 97 moves to step S17 where a judgment is made as to whether or not a height redetection time has elapsed. This redetection time is the same amount of time as the predetermined time period (e.g., several hundred hours) in the above embodiment. If the redetection time has elapsed, the height detection unit 97 moves to step S12. If the redetection time has not elapsed, the height detection unit 97 moves to step S18 where it continues as is the current cooling operation using the high-pressure setting conforming to the indoor unit 30 in which the largest height has been detected among the indoor units 30 in operation.

In step S12, the height detection unit 97 supposes the values of the heights to be a design upper limit in regard to all of the indoor units 30 and starts a cooling operation using a high-pressure setting based on the values of the heights of that design upper limit. For example, in a case where the design upper limit is 40 m, the height detection unit 97 controls the operating frequency of the compressor 21 and so forth using a high-pressure setting based on that height of 40 m.

In step S13, the height detection unit 97 calculates the outputs of each of the indoor units 30 using a characteristic formula of each of the indoor units 30. Specifically, the height detection unit 97 calculates the outputs of each of the indoor units 30 using a characteristic formula from the air volumes of the indoor fans 43, the evaporation saturation temperatures (Te) of the indoor heat exchangers 42, and the degrees of superheat (SH) of the refrigerant in the outlets of the indoor heat exchangers 42 and the like.

In step S14, the height detection unit 97 calculates the enthalpies in the inlets and outlets of the indoor heat exchangers 42 from the temperatures that have been measured by each of the temperature sensors and finds the differences between those enthalpies. Moreover, the height detection unit 97 calculates the amounts of refrigerant in circulation in regard to each of the indoor units 30 from the differences between the enthalpies in the inlets and outlets of the indoor heat exchangers 42 and the outputs of the indoor units 30 found in step S13.

In step S15, the height detection unit 97 calculates the pressures of the refrigerant in the inlets of the indoor expansion valves 41 of each of the indoor units 30 from the evaporation saturation temperatures of the indoor heat exchangers 42, the opening degrees of the indoor expansion valves 41, and the amounts of refrigerant in circulation calculated in step S14.

Then, in step S16, the height detection unit 97 computes and detects the heights of each of the indoor units 30 from the pressure of the refrigerant in the outdoor unit 20 (the discharge pressure of the compressor 21) and the pressures of the refrigerant in the inlets of each of the indoor expansion valves 41 calculated in step S15 and stores those heights in the height storage unit 97*a*.

Figure 5:
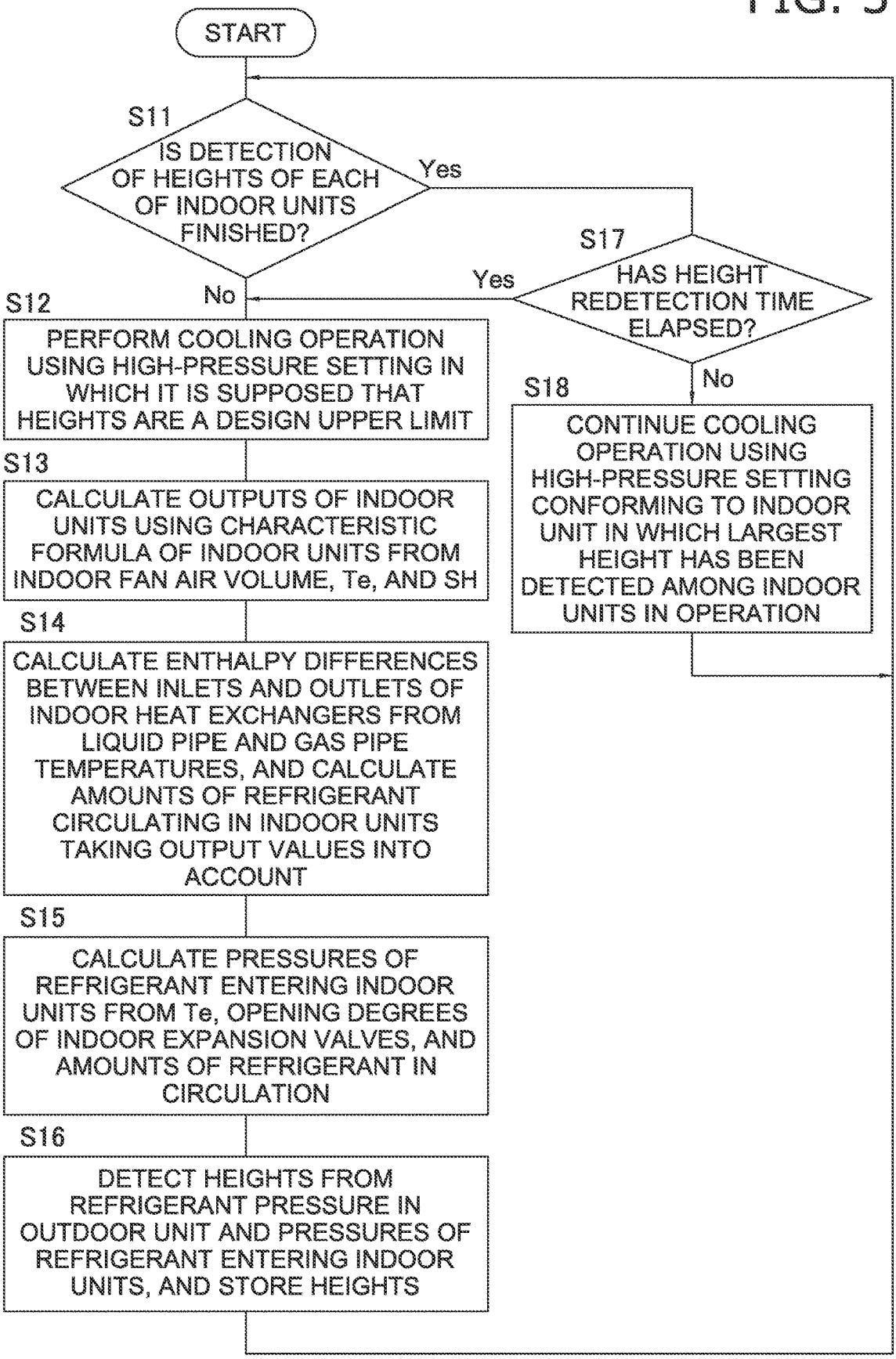
FIG. 5 is a control flow diagram of a height detection operation of the air conditioning system pertaining to example modification A.

Even in a case where the height detection operation has been performed by the control flow shown in FIG. 5 and described above, by performing high-pressure control on the basis of the value of the largest height of the indoor units 30 in operation like in the air conditioning system 10 pertaining to the above embodiment, inefficient operations in which the operating frequency of the compressor 21 is raised more than necessary to increase the refrigerant pressure can be eliminated, and the air conditioning system 10 can operate efficiently.

Furthermore, in a case where the height detection operation is performed by the control flow shown in FIG. 5, the detection operation is performed using a high-pressure setting based on the values of the heights of the design upper limit, so there is no situation where some of the liquid refrigerant ends up gasifying before entering the indoor expansion valves 41 of each of the indoor units 30, and there are virtually no disadvantages such as abnormal noises occurring in the indoor expansion valves 41 in the detection operation.

(5-2) Example Modification B

In the air conditioning system 10 pertaining to example modification A, the height detection unit 97 calculates the outputs of, and the amounts of refrigerant circulating in, each of the indoor units 30 and calculates the pressures of the refrigerant in the inlets of the indoor expansion valves 41 of each of the indoor units 30, but instead of this, pressure sensors may also be installed in each of the indoor units 30 to directly measure the refrigerant pressures. In this case, the refrigerant pressures in the indoor units 30 can be detected more accurately. However, the price of the indoor units 30 increases.

(5-3) Example Modification C

In the air conditioning system 10 pertaining to the above embodiment, "operation is stopped" is defined as a case where a user has intentionally issued, using a remote controller or the like, a command to an indoor unit 30 to stop operating. However, in a case where a thermostat-off state or a blowing state is continuing for a long time in an indoor unit 30 even in operation, the indoor expansion valve 41 is switched to a stopped opening degree, so this case can also be thought of as being included in "operation is stopped," In a case where the indoor unit in-operation/stopped status determination unit 95 determines whether the indoor units 30 are in operation or stopped on the basis of a definition like that, energy saving is further promoted. However, the disadvantage that high-pressure control will not soon catch up when the thermostat is switched from off to on is also conceivable, so "operation is stopped" is defined in light of the order of priority between good responsiveness and saving energy.

(5-4) Example Modification D

In the air conditioning system 10 pertaining to the above embodiment, the values of the heights themselves of each of the indoor units 30 with respect to the outdoor unit 20 are stored in the height storage unit 97*a* of the height detection unit 97. Instead of this, the height detection unit 97 may also be caused to detect amounts of decrease in the pressures of the refrigerant caused by the heights and to store those amounts of pressure decrease as height-associated values in the height storage unit 97*a* for each of the indoor units 30.

(5-5) Example Modification E

In the air conditioning system 10 pertaining to the above embodiment, in the height detection operation implemented by the height detection unit 97, the height detection unit 97 adjusts the supposed height values of each of the indoor units 30 on the basis of whether or not the behaviors of the indoor expansion valves 41 are diverging and finds the true height values of each of the indoor units 30.

Instead of this, the height detection unit 97 may also detect the heights by finding the values of the heights in regard to just one of the plural indoor units 30 belonging to each of the groups to G6 and using the values of the heights for the other indoor units 30 of the same groups G1 to G6.

For example, during or before a test operation after the installation of the air conditioning system 10, group settings for each of the indoor units 30 may be made in the control unit 8 by a test operation tool, and the height detection unit 97 may find the values of the heights in regard to just six of the indoor units 30 the indoor unit 31*a* belonging to the group G1, the indoor unit 32*a* belonging to the group G2, the indoor unit 33*a* belonging to the group G3, the indoor unit 34*a* belonging to the group G4, the indoor unit 35*a* belonging to the group G5, and the indoor unit 36*a* belonging to the group G6 on the basis of whether or not the behaviors of the indoor expansion valves 41 are diverging.

In a case where the air conditioning system 10 is configured in this way, the heights can be detected in regard to all of the indoor units 30 in a relatively short amount of time without having to perform a special operation for detecting the heights in regard to all of the indoor units 30.

(5-6) Example Modification F

In the air conditioning system 10 pertaining to the above embodiment, the first height detection operation is started during the first cooling operation after the installation of the air conditioning system 10, and subsequent height detection operations from the second time on are started during the normal cooling operation.

However, the height detection may also be always implemented during the normal cooling operation. In that case, the indoor expansion valves 41 in the above embodiment control the degrees of superheat in the outlets of the indoor heat exchangers 42 in the same way as during the normal cooling operation, and the height detection unit 97 determines whether or not the behaviors of the indoor expansion valves 41 are diverging from the actions of the indoor expansion valves 41 and the behaviors of the degrees of superheat in the outlets of the indoor heat exchangers 42 at that time.

It is not always the case that all of the outdoor units invariably operate during the first cooling operation, so the problem that there is the potential for there to be an indoor unit 30 whose height is not known until a subsequent height detection operation from the second time on can be solved by always implementing the height detection during the normal cooling operation.

Furthermore, in a case where the height detection is always implemented during the normal cooling operation as described above, it is preferred that the stored values of the heights of all of the indoor units 30 stored in the height storage unit 97*a* be periodically changed to "−5 m". With just the determination of step S4 in FIG. 4, detection is performed only in the direction in which the values of the heights of each of the indoor units 30 are increased, so depending on the detection precision there is the potential for excessive height values to be stored, but in a case where the air conditioning system 10 is configured in this way, it becomes possible to correct such determination mistakes.

(5-7) Example Modification G

In the air conditioning system 10 pertaining to the above embodiment, the first height detection operation is started during the first cooling operation after the installation of the air conditioning system 10, and subsequent height detection operations from the second time on are started during the normal cooling operation.

However, depending on the detection precision of the first height detection operation, subsequent height detection operations from the second time on may not be necessary.

Furthermore, the first height detection operation may also be performed during a test operation in which all of the indoor units 30 can be forcibly made to perform the cooling operation. In this case, the air conditioning system 10 operates at a low capacity in order to suppress a drop in the temperatures of the rooms, and there is the disadvantage that it becomes difficult to detect pressure loss in the first refrigerant connection pipe 6, but there is also the advantage that one does not have to worry about abnormal noises that occur as a result of the gas-liquid two-phase refrigerant flowing through the indoor expansion valves 41.

What is claimed is:

1. A refrigeration system comprising:

a heat source unit having a compressor and a heat source-side heat exchanger that functions as a radiator;

a plurality of utilization units, each utilization unit having an expansion valve and a utilization-side heat exchanger that functions as an evaporator; and a control unit including a microcomputer, the microcomputer serving as:

a height-associated value detection unit configured to detect height-associated values of each utilization unit, the height associated value of each utilization unit corresponding to a height of the utilization unit, the height of each utilization unit being a vertical distance between the utilization unit and the heat source unit, the plurality of utilization units being disposed at different vertical heights with respect to the heat source, and an operation control unit configured to determine whether each of the utilization units is an in-operation state or a stopped state, a plurality of utilization units being found to be in an in-operation state and at least one utilization unit being found to be in a stopped state, to control a speed of the compressor during a cooling operation based on a height-associated value of the utilization unit disposed at a highest height among the plurality of the utilization units that have been determined to be in operation without using the height-associated value of the utilization unit that have been determined to be stopped, to increase the speed of the compressor when the operation control unit determines that at least one of the plurality of utilization units disposed at a higher height becomes in operation, and to decrease the speed of the compressor when the operation control unit determines that the utilization units disposed at a higher height are stopped and at least one of the plurality of utilization unit disposed at a lower height is in operation.

2. The refrigeration system according to claim 1, wherein the expansion valves have adjustable opening degrees, and the height-associated value detection unit is configured to detect the height-associated values of the utilization units by first having the refrigeration system perform a cooling operation using temporary height-associated values and adjusting the temporary height-associated values based on changes in state of refrigerant with respect to adjustments to the opening degrees of the expansion valves.

3. The refrigeration system according to claim 2, wherein the height-associated value detection unit is further configured to first have the refrigeration system perform a cooling operation using temporary height-associated values that are height-associated values of the utilization units in a case where the heights are zero, repeatedly adjust the temporary height-associated values based on changes in the state of the refrigerant with respect to adjustments to the opening degrees of the expansion valves, and when magnitudes of the changes in the state of the refrigerant with respect to the adjustments to the opening degrees of the expansion valves fall within a predetermined range, store the adjusted temporary height-associated values as the height-associated values of the utilization units.

4. The refrigeration system according to claim 3, wherein the height-associated value detection unit is further configured to adjust the temporary height-associated values based on changes in degrees of superheat of the refrigerant in outlets of the utilization-side heat exchangers with respect to adjustments to the opening degrees of the expansion valves.

5. The refrigeration system according to claim 1, wherein the expansion valves have adjustable opening degrees, and the height-associated value detection unit is configured to detect the height-associated values of the utilization units by first having the refrigeration system perform a cooling operation using temporary height-associated values that are height-associated values of the utilization units in a case where the heights are an upper limit, determining amounts of refrigerant flowing through each of the utilization units, and calculating pressures of the refrigerant when the refrigerant enters each of the utilization units from the opening degrees of the expansion valves of the utilization units.

6. The refrigeration system according to claim 1, wherein the height-associated value detection unit is configured to detect the height-associated value of each of the utilization units during a test operation performed at a time of installation of the heat source unit and the plurality of utilization units or during a cooling operation.

7. The refrigeration system according to claim 3, wherein the height-associated value detection unit is further configured to periodically have the refrigeration system perform a cooling operation using temporary height-associated values that are smaller than the height-associated values of the utilization units that are stored and redetect the height-associated values of the utilization units.

8. The refrigeration system according to claim 4, wherein the height-associated value detection unit is further configured to periodically have the refrigeration system perform a cooling operation using temporary height-associated values that are smaller than the height-associated values of the utilization units that are stored and redetect the height-associated values of the utilization units.

9. The refrigeration system according to claim 1, wherein the plurality of utilization units belong to any of a plurality of groups, and the height-associated value detection unit is configured to detect the height-associated value of one of the utilization units in each of the groups and to apply the detected height-associated values to the other utilization units in the groups.

10. The refrigeration system according to claim 3, wherein the height-associated value detection unit is further configured to periodically have the refrigeration system perform a cooling operation using temporary height-associated values that are smaller than the height-associated values of the utilization units that are stored and redetect the height-associated values of the utilization units.

* * * * *